United States Patent [19]

Cosmopulos

[11] 4,157,828

[45] Jun. 12, 1979

[54] DISC LAUNCHING AND CATCHING DEVICE

[76] Inventor: Stavros Cosmopulos, 8 Bridge St., Norwell, Mass. 02061

[21] Appl. No.: 829,733

[22] Filed: Sep. 1, 1977

[51] Int. Cl.[2] ..... A63B 65/12

[52] U.S. Cl. ..... 273/96 R; 124/5; 124/50; 124/81

[58] Field of Search ..... 273/96 R, 96 B, 96 C, 273/96 D, 106 B; 124/5, 50, 47, 20 A

[56] References Cited

U.S. PATENT DOCUMENTS

| | | | |
|---|---|---|---|
| 1,022,186 | 4/1912 | Engler | 273/96 R |
| 1,186,098 | 6/1916 | Horst | 124/5 |
| 2,321,371 | 6/1943 | Du Pont | 273/86 R |
| 2,586,547 | 2/1952 | Marley | 124/5 |
| 2,996,058 | 8/1961 | Ervine | 124/47 X |
| 3,464,155 | 9/1969 | Capalia et al. | 124/5 X |
| 3,618,585 | 11/1971 | Allison | 124/20 A |
| 4,076,004 | 2/1978 | Huelskamp | 124/5 |

FOREIGN PATENT DOCUMENTS

| | | | |
|---|---|---|---|
| 661779 | 6/1938 | Fed. Rep. of Germany | 273/96 R |
| 753192 | 10/1933 | France | 124/5 |
| 591257 | 8/1947 | United Kingdom. | |

*Primary Examiner*—George J. Marlo

*Attorney, Agent, or Firm*—Morse, Altman, Oates & Bello

[57] ABSTRACT

A hand held device is provided for use in launching and catching a disc that is spun back and forth between players. The device includes a handle at one end of an elongated curved head having closely spaced parallel side walls on either side of a curved track to form a slot. The disc is placed in the slot near the handle end and is launched by a horizontal whipping motion causing the disc to roll down the track and spin away from the free end of the head towards the other player. To facilitate catching the disc, the sidewalls of the head may be flared outwardly to a certain extent at the mouth of the slot. The head may also be provided with a second elongated disc receiving receptacle which is located at the end of the track opposite the handle, and oriented perpendicular to the parallel side walls. In another embodiment, the launching device may include a storage chamber for a plurality of discs and a trigger control mechanism which permits the stored discs to be launched one at a time.

10 Claims, 17 Drawing Figures

DISC LAUNCHING AND CATCHING DEVICE

BACKGROUND OF THE INVENTION

1. Field of the Invention

This invention relates generally to game equipment and more particularly is directed towards a novel device for launching and catching a disc spun back and forth between players, each equipped with a device.

2. Description of the Prior Art

A popular sport has developed in which two or more players toss a semi-rigid disc back and forth. The disc, when spun horizontally, will demonstrate certain aerodynamic characteristics and, with skill, one player can toss the disc so that it will follow a prescribed path towards the other player who attempts to catch it in mid-air.

Heretofore, the throwing and catching of the disc has been done by hand, which is a self-limiting factor with respect to the skill and enjoyment of the game.

Accordingly, it is an object of the present invention to provide a game device for use in launching and catching a disc to thereby increase the enjoyment of the pastime. Another object of the invention is to provide a hand held disc-launching device which effectively increases the reach of a player and with practice and dexterity a player's interest in the game is increased.

SUMMARY OF THE INVENTION

This invention features a game device for use in launching and retrieving a disc of the sort normally thrown by spinning between one player and another. The device is comprised of an elongated member having a handle at one end and a curved head at the other end thereof. The head includes a pair of spaced parallel side walls extending forwardly from a curved track and defining therewith a slot in which the disc is placed near the handle end. The disc is launched by a whipping action of the device, causing the disc to spin along the track and to fly off the end thereof toward the target. The disc is retrived by holding the device so that the slot is in position to catch the disc as it is returned from the other player. To facilitate catching the disc, the side walls of the head may be flared outwardly to a certain extent at the mouth of the slot.

DETAILED DESCRIPTION OF THE PREFERRED EMBODIMENTS

Figure 7:
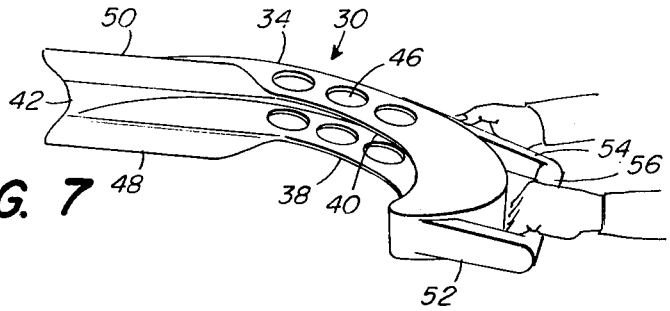
FIG. 7 is a view in perspective showing a modified disc-launching and retrieving device.

Referring now to the drawings and to FIGS. 1 through 4 in particular, the reference character 10 generally indicates a launcher for a disc 12 comprised of a handle portion 14 at one end and a head portion 16 at the other end thereof. The launcher may be fabricated from a variety of materials, such as rigid or semi-rigid plastic, wood, metal, or a combination thereof, for example. The launcher head portion 16 is comprised of a pair of side walls 18 and 20 substantially parallel to one another and connected at their trailing edges by means of a rear wall 22 extending from the handle end 14 to the free end thereof and defining a curved track 24 along which the disc 12 is spun when being launched. The track should be reasonably long in relation to the size of the disc and in practice a track length of four to six times the diameter of the disc may be used to advantage. By way of example, when using a disc of 4" in diameter, a track length of about 24" provides satisfactory results. In such an embodiment, the track has an average radius of curvature of approximately 10" and the launcher has an overall length of approximately 20". Obviously, these dimensions are only by way of example and may be altered over a wide range.

Typically, the disc, if of a 4" diameter, has an overall depth on the order of about ½", the disc being of concave circular configuration and propelled with the concave face down and the convex side up, in which position the disc will travel in a relatively flat trajectory for a considerable distance. Such discs normally are molded from a semi-rigid plastic material such as PVC or the like. Assuming a disc with a ½" depth, then the spacing between the side walls 18 and 20 should be approximately ⅝". The slot depth defined by the width of the walls should be sufficient to hold a disc within the slot, even when the launcher is held in the horizontal position ready for launching. Thus, a wall width of approximately one-half the diameter of the disc will suffice, with the width gradually tapering towards the tip of the launcher.

The handle portion 14 is provided on the rear inner end of the launcher and includes a grip formed by an oval-shaped opening 26 by means of which the player may grasp the launcher by either hand.

Figure 2:
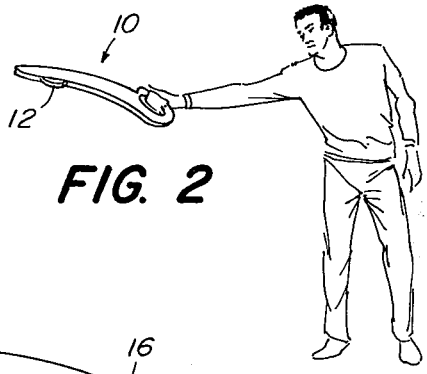
FIG. 2 is a view in perspective illustrating typical use of the device.

The launcher is used in the manner best shown in FIG. 2, being held by means of the handle in either hand. The player inserts the disc 12 in the slot, preferably as close in to the handle as possible, holding the launcher in a horizontal or slightly tipped position so that the disc will not fall out of the slot. The launcher is then swung by the player in the direction in which the disc is to fly. Using a whipping action in which the launcher is stroked toward the opponent, the disc will roll along the curved back wall of the slot and be released from the end of the launcher in flat, spinning trajectory. While a sideways motion is usually employed, the disc may also be launched by overhead or underhand motions. With some practice, considerable accuracy may be developed as well as an increase in distance and velocity by virtue of the leverage inherent in the launcher. Also with practice, a player can catch a returning disc in mid-flight by holding the launcher in the direct path of the disc so that the disc will enter the slot and be trapped thereby. Thus, two players using similar launchers may toss a disc back and forth between themselves using only the launcher to throw and retrieve the disc.

Figure 4:
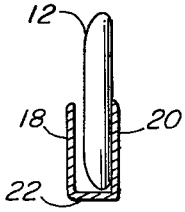
FIG. 4 is a cross-sectional view taken along the line 4—4 of FIG. 3, FIGS. 5 and 6 are views similar to FIG. 4 but showing modifications thereof.

The slot formed in the head of the launcher, as best shown in FIG. 4, provides sufficient lateral support and clearance to guide the disc 12 so that it will roll freely along the track 24 with very little wobble and be released in a smooth, flat, spinning motion.

Figure 5:
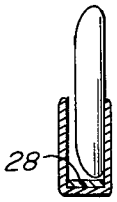
Figure 6:
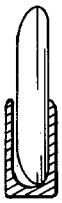

In order to increase the frictional contact between the periphery of the disc and the launcher and thereby provide a more positive spinning action to the disc when the launcher is used, a layer 28 (FIG. 5) of rubber or the like may be applied along the track 24. The layer 28 may be transversely ribbed or of a somewhat spongy consistency in order to provide maximum traction for the disc. An alternative measure for increasing the frictional contact with the disc edge would be to contour the rear portion of the slot to conform generally with the profile of the disc edge, as best shown in FIG. 6.

Figure 8:
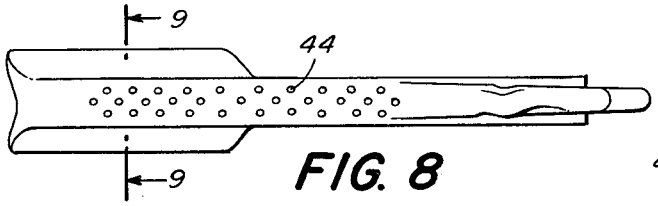
FIG. 8 is a rear view thereof.
Figure 3:
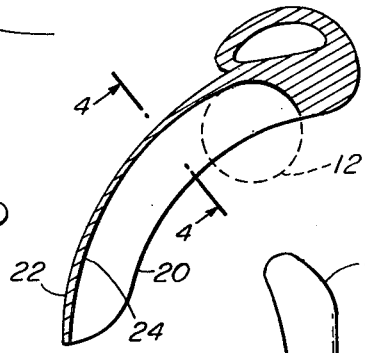
FIG. 3 is a sectional view in side elevation thereof.
Figure 9:
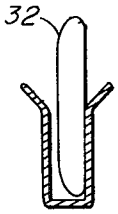
FIG. 9 is a cross-sectional view taken along the line 9—9 of FIG. 8.

Referring now to FIGS. 7, 8 and 9, there is illustrated a modification of the invention and in this embodiment a somewhat larger launcher 30 is illustrated for use with a standard size disc 32. Typically the disc 32 has a diameter on the order of about 9½" and a depth of about 1" thereby requiring a launcher with dimensions somewhat greater than those set forth in connection with the FIG. 1 embodiment.

The launcher 30 of FIGS. 7, 8 and 9 has an overall length of approximately 26" and includes a curved head portion 34 and a handle portion 36, the head being formed with spaced parallel side walls 38 and 40 joined by a curved rear wall 42 defining a slot of approximately 1½" in width and an average depth of approximately 3½". The track length defined by the inner face of the rear wall is approximately 35" from end to end, with an average radius of curvature of approximately 15" over a major portion of the track.

In order to reduce wind resistance when swinging the launcher, the rear wall 42 is formed with a number of perforations 44 while the side walls 38 and 40 are formed with openings 46 to reduce weight.

Retrieval of the disc is facilitated by means of outwardly flared lips 48 and 50 provided along the forward edges of the side walls 38 and 40. The lips provide a mouth to guide the returning disc into the slot. In practice, the lips may extend a length of perhaps 10" or so and have a width of perhaps 1½". The lips may, of course, extend along the entire leading edge of the side walls if desired.

The handle portion 36 of the FIG. 7 embodiment includes a pair of braces 52 and 54 extending from the inner end of the rear wall 42 and joined by a cross bar 56 of perhaps 9" in length. In practice, the launcher is held with both hands, typically the left hand holding the cross bar 56 while the right hand grips the rear brace 54. Hand positions would, of course, be reversed for a left-handed player. The use of the launcher is the same as in the principal embodiment, with the disc 32 placed in the slot and released by a whipping action.

Figure 10:
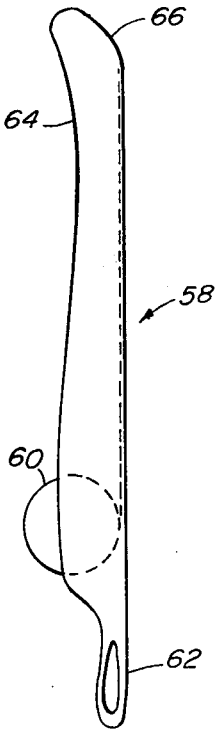
FIG. 10 is a view in side elevation showing another modification of the invention.

Referring now to FIG. 10, there is illustrated another modification of the invention and in this embodiment a launcher 58 is provided with a track that is straighter than in the previous embodiments. As before, the launcher includes a handle 62 and head 64 formed with a slot in which the disc is placed. However, in this embodiment, instead of a continuously curving track at the base of the slot, a substantially straight track is provided over the major portion of the length of the head, terminating in a curved outer end 66 towards the mouth of the slot. The track length may be varied according to the size of the disc being used and, for a standard size disc, a track length of approximately 33" may be used. The side walls of the head may be formed with openings to reduce weight and the rear wall may be perforated to reduce wind resistance. The handle 62 may be a straight, solid piece or may be formed with an opening as shown.

Figure 11:
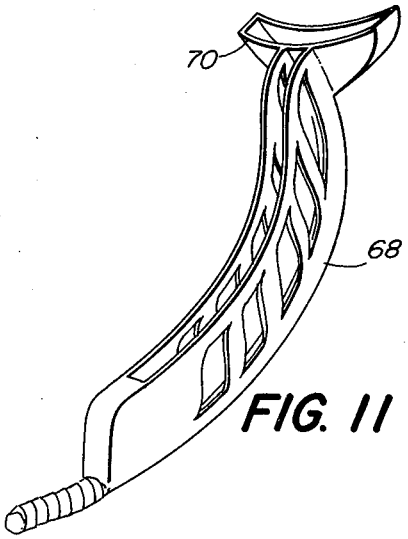
FIG. 11 is a view in perspective showing a further modification of the invention.

Referring now to FIG. 11, there is illustrated another modification of the invention, and in this embodiment a launcher 68, which may be similar in construction to any of the foregoing launchers, is provided with a semicircular cup 70 at the outer end of the launcher head. The cup 70 faces in the same direction as the slot opening for the launcher but is oriented 90° with respect to the length of the launcher. The cup is dimensioned to receive the disc with a slight amount of clearance therewith. The function of the cup is to retrieve or catch a disc that may be too high to catch with the main slot of the launcher and, with practice, a player may catch a high flying disc in full flight by positioning the mouth of the cup directly in the path of the disc.

Figure 12:
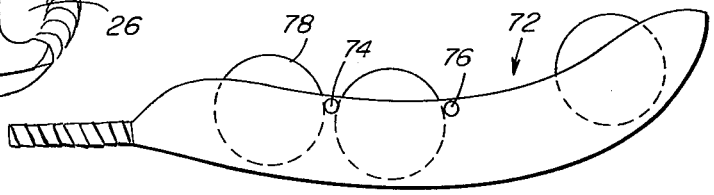
FIG. 12 is a view in side elevation showing yet another modification of the invention.

Referring now to FIG. 12, there is illustrated still another modification of the invention, and in this embodiment a launcher 72, which may be similar in construction to any of the foregoing devices, is provided with several spaced openings 74 and 76 in the side walls of the launcher head. The openings are spaced apart by a distance corresponding to the diameter of the disc 78 so that several discs may be placed in the launcher and released one at a time. The discs not to be released are held by placing a finger in one or more holes 74 or 76 and whipping the launcher to release the outermost free disc. Thus, the disc may be launched in rapid succession by releasing one after the other.

Figure 13:
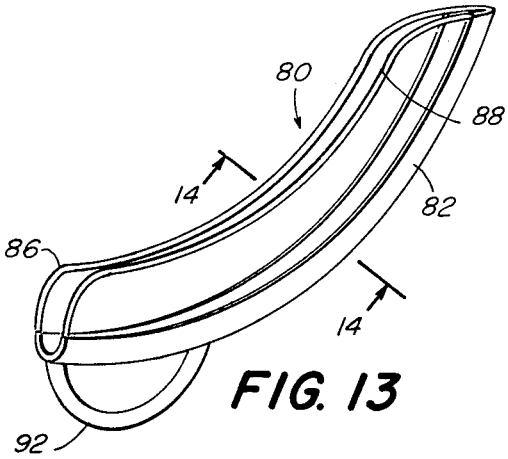
FIG. 13 is a perspective view showing still another modification of the invention.
Figure 14:
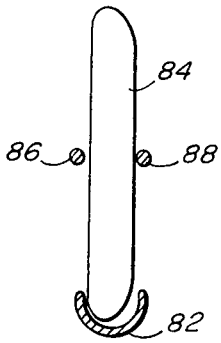
FIG. 14 is a cross-sectional view taken along the line 14—14 of FIG. 13.

Referring now to FIGS. 13 and 14, there is illustrated a lightweight disc launcher organized about a curved channel member 82 of U-shaped cross-section formed with relatively shallow side walls and serving as a track for a disc 84. The disc 84 is held within the track by means of relatively stiff guide wires 86 and 88 extending from end to end of the track and spaced from the member 82 by a distance generally corresponding to the width of the side walls in the principal embodiment. The guide wires are attached to opposite ends of the member 82 in a curved configuration as shown. A handle 90 is also provided.

Figure 1:
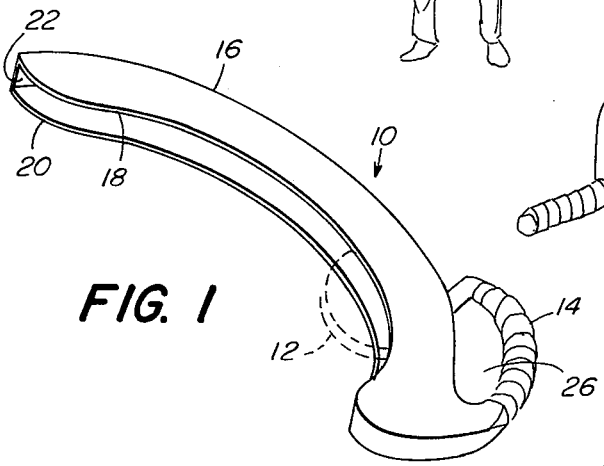
FIG. 1 is a view in perspective of a disc launching and retrieving device made according to the invention.
Figure 15:
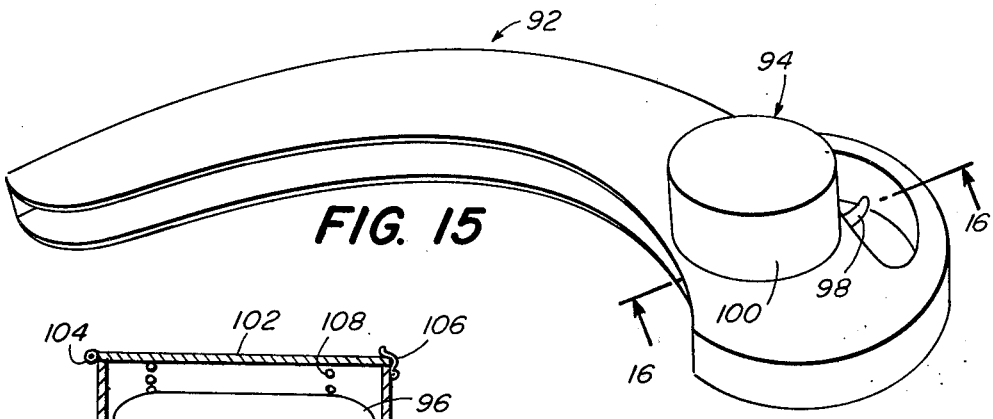
FIG. 15 is a perspective view showing yet another modification of the invention.
Figure 16:
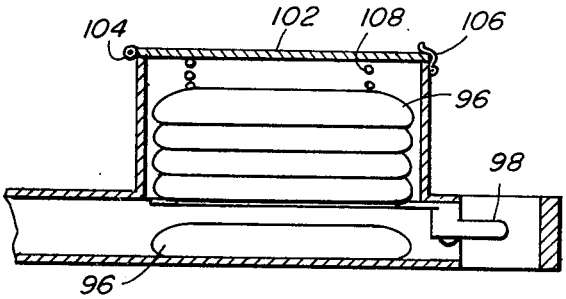
FIG. 16 is a cross-sectional view taken along the line 16—16 of FIG. 15, and, FIG. 17 is a detail sectional view in side elevation showing the release mechanism of the FIG. 15 device.
Figure 17:
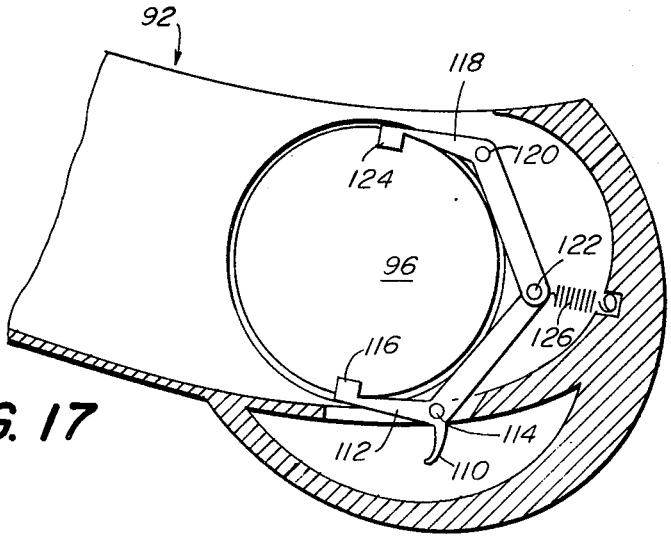

Referring now to FIGS. 15 through 17, there is illustrated a further modification of the invention, and in this embodiment a launcher 92 is similar in overall configuration to that of the FIG. 1 embodiment, with the exception that a trigger-operated feeding mechanism 94 is provided by means of which the launcher may be loaded with a number of discs 96 and released one at a time by operating a trigger 98. As shown, the disc feeding mechanism comprises a cylindrical housing 100 mounted to one side of the launcher near the handle end thereof and includes a cover 102 hinged at 104 and secured by means of a latch 106. A compressed coil spring 108 is mounted within the cover by means of which a stack of discs 96 may be loaded for later release. The stack of discs is held within the housing at the inner end by means of a release mechanism comprised of the trigger 110 connected to a link arm 112. The link arm 118 is also provided with a finger 124 at a position opposite the finger 116. A tension spring 126 connects two link arms to the body of the launcher and normally urges the fingers 116 and 124 inwardly to engage the stack. By pulling back on the trigger 110, both link arms are pivoted simultaneously, causing the fingers 116 and 124 to retract the release a disc. When pressure on the trigger is relieved, the link arms return to their normal position to engage the stack. The released disc drops into the track of the launcher and is thrown in the usual manner.

While the invention has been described with particular reference to the illustrated embodiments, numerous modifications thereto will appear to those skilled in the art without departing from the spirit of the invention. For example, the launcher, while primarily adapted for use as a game device, could be used for other purposes such as the throwing of disc-shaped grenades, life lines wrapped about flat spools or the like.

Having thus described the invention, what I claim and desire to obtain by Letters Patent of the United States is:

1. A game device for launching and retrieving a disc spun back and forth between players, comprising in combination, (a) a concave circular disc, and, (b) an elongated and substantially rigid body formed with a head at one end and a handle at the opposite end thereof, (c) said head including a pair of spaced and substantially parallel, relatively wide side walls and a relatively narrow transverse rear wall connected between said side walls and recessed from the open end thereof to form a slot adapted to receive said disc inserted edgewise therein, (d) the distance between said side walls being slightly greater than the depth of said disc, (e) said rear wall defining a track for the peripheral edge of said disc and at least the outer portion of said rear wall being curved towards the outer end of said head and the mouth of said slot, (f) the depth of said slot over the major portion of said head generally corresponding with the radius of said disc, (g) the outer edges of said side walls along the entrance to said slot being flared outwardly to guide a disc into said slot.

2. A game device, according to claim 1, including a layer of frictional material along the inner face of said rear wall for enhancing the frictional contact with the edge of said disc.

3. A game device, according to claim 1, including a receptacle mounted at the outer end of said head, said receptacle being formed with an opening dimensioned to accommodate a disc moved edgewise therein, the mouth of said receptacle facing in the same direction as the mouth of said slot but oriented generally perpendicular with respect thereto.

4. A game device, according to claim 1, wherein said rear wall is curved from end to end.

5. A game device, according to claim 1, wherein at least one of said side walls is formed with at least one opening near the handle end of said head whereby a disc at the inner end of said track may be restrained by a finger placed in said opening.

6. A game device, according to claim 1, wherein the medial portion of said rear wall is straight.

7. A game device, according to claim 1, wherein said rear wall is longitudinally contoured to conform to the peripheral profile of said disc.

8. A game device, according to claim 1, including disc storage means mounted to said body for storing a quantity of said discs and release means connected to said storage means for releasing individual discs from said storage means to said track.

9. A game device, according to claim 8, wherein said storage means includes a housing mounted to one of said side walls, said one side wall being formed with an opening communicating with said housing.

10. A game device, according to claim 9, wherein said release means includes at least one finger movably mounted to said one side wall proximate to said opening and actuating means for moving said finger to and away from said opening for engaging and disengaging a disc in said housing.

* * * * *